US012631015B2

(12) United States Patent
Preston

(10) Patent No.: US 12,631,015 B2
(45) Date of Patent: May 19, 2026

(54) METHOD OF CONSTRUCTION

(71) Applicant: John Clement Preston, Silverwater (AU)

(72) Inventor: John Clement Preston, Silverwater (AU)

( * ) Notice: Subject to any disclaimer, the term of this patent is extended or adjusted under 35 U.S.C. 154(b) by 640 days.

(21) Appl. No.: 17/787,696

(22) PCT Filed: Dec. 23, 2020

(86) PCT No.: PCT/AU2020/051429

§ 371 (c)(1),
(2) Date: Jun. 21, 2022

(87) PCT Pub. No.: WO2021/127741

PCT Pub. Date: Jul. 1, 2021

(65) Prior Publication Data

US 2023/0014744 A1 Jan. 19, 2023

(30) Foreign Application Priority Data

| | | |
|---|---|---|
| Dec. 24, 2019 | (AU) | 2019904948 |
| Oct. 2, 2020 | (AU) | 2020903581 |
| Oct. 22, 2020 | (AU) | 2020903837 |

(51) Int. Cl.

| | |
|---|---|
| ***E04B 1/35*** | (2006.01) |
| ***E04B 1/348*** | (2006.01) |
| ***E04G 21/32*** | (2006.01) |

(52) U.S. Cl.
CPC ..... *E04B 1/35* (2013.01); *E04B 1/34815* (2013.01); *E04G 21/3204* (2013.01)

(58) Field of Classification Search
CPC .... E04B 1/34815; E04B 1/34823; E04B 1/35; E04G 21/3204
See application file for complete search history.

(56) References Cited

U.S. PATENT DOCUMENTS 3,881,699 A * 5/1975 Nusbaum ..... E04G 21/3247 256/65.05
4,108,322 A 8/1978 Kochanneck
(Continued)

FOREIGN PATENT DOCUMENTS

CN 1483105 A 3/2004
CN 1525020 A 9/2004
(Continued)

OTHER PUBLICATIONS

International Application No. PCT/AU2020/051429, International Search Report and Written Opinion, mailed Feb. 16, 2021.
(Continued)

*Primary Examiner* — Christine T Cajilig
(74) *Attorney, Agent, or Firm* — MARSHALL, GERSTEIN & BORUN LLP

(57) ABSTRACT

A method of erecting a multi-storey structure is disclosed. During construction, at least a portion of a perimeter facade of the structure is disposed to extend at least two storeys height beyond an upper work area of the structure and forms at least part of a safety barrier for that work area and wherein in erecting the multi-story structure, at least one further floor of the structure is erected over the upper work area. The further floor forming a respective subsequent upper work area of the structure, and wherein at least a portion of the facade is disposed to extend at least one storey height beyond the uppermost of the subsequent work areas.

9 Claims, 6 Drawing Sheets

(56) References Cited

U.S. PATENT DOCUMENTS

| | | | | |
|---|---|---|---|---|
| 4,555,890 | A * | 12/1985 | Gartner | E04B 2/88 52/745.11 |
| 4,716,695 | A | 1/1988 | Alexander et al. | |
| 5,014,477 | A | 5/1991 | MacDonald | |
| 5,158,392 | A | 10/1992 | Takeda | |
| 5,177,913 | A | 1/1993 | Erel | |
| 5,826,381 | A | 10/1998 | Sasaki | |
| 6,301,848 | B1 | 10/2001 | Whitaker | |
| 7,644,549 | B2 | 1/2010 | Speck | |
| 7,681,366 | B2 | 3/2010 | De Gobbi | |
| 7,900,410 | B2 | 3/2011 | Skendzic et al. | |
| D663,043 | S | 7/2012 | Preston | |
| 8,359,797 | B2 | 1/2013 | Lee | |
| D689,201 | S | 9/2013 | Preston | |
| 9,909,326 | B2 | 3/2018 | Preston | |
| 10,738,496 | B2 | 8/2020 | Schmitt et al. | |
| 11,808,035 | B2 | 11/2023 | Preston | |
| 2002/0146305 | A1 | 10/2002 | Haag | |
| 2003/0033764 | A1 | 2/2003 | Ting | |
| 2004/0237439 | A1* | 12/2004 | Powell | E04B 1/34823 52/505 |
| 2005/0095092 | A1 | 5/2005 | Segal et al. | |
| 2006/0016133 | A1 | 1/2006 | Speck | |
| 2006/0228196 | A1 | 10/2006 | Li | |
| 2007/0094942 | A1* | 5/2007 | Dougall | E04B 5/40 52/64 |
| 2007/0294952 | A1 | 12/2007 | Li | |
| 2008/0222981 | A1 | 9/2008 | De Gobbi | |
| 2010/0017016 | A1 | 1/2010 | Zangerle | |
| 2010/0050547 | A1 | 3/2010 | Speck | |
| 2010/0218443 | A1 | 9/2010 | Studebaker et al. | |
| 2010/0300021 | A1 | 12/2010 | Falk | |
| 2013/0048430 | A1 | 2/2013 | Preston | |
| 2015/0152658 | A1 | 6/2015 | Rosati | |
| 2016/0251812 | A1 | 9/2016 | Preston | |
| 2017/0022699 | A1 | 1/2017 | Lim | |
| 2017/0211287 | A1 | 7/2017 | Schmitt et al. | |
| 2018/0073257 | A1 | 3/2018 | Preston | |
| 2018/0119421 | A1 | 5/2018 | Pospisil et al. | |
| 2018/0230692 | A1 | 8/2018 | Thebaud | |
| 2018/0354733 | A1 | 12/2018 | Preston | |
| 2019/0093349 | A1 | 3/2019 | LeVan | |
| 2019/0136507 | A1* | 5/2019 | Argyrou | E04B 1/34815 |
| 2020/0181905 | A1 | 6/2020 | Jarck | |
| 2021/0172169 | A1 | 6/2021 | Toffoli | |
| 2021/0180341 | A1 | 6/2021 | Preston | |
| 2021/0310241 | A1 | 10/2021 | Preston | |
| 2021/0324642 | A1 | 10/2021 | Preston | |
| 2021/0404181 | A1 | 12/2021 | Naim Ibrahim | |

FOREIGN PATENT DOCUMENTS

| | | | |
|---|---|---|---|
| CN | 1802477 | A | 7/2006 |
| CN | 101861438 | A | 10/2010 |
| CN | 104088366 | A | 10/2014 |
| CN | 105275087 | A | 1/2016 |
| CN | 105756404 | A | 7/2016 |
| CN | 106381923 | A | 2/2017 |
| CN | 206289794 | U | 6/2017 |
| CN | 206570920 | U | 10/2017 |
| CN | 107700747 | A | 2/2018 |
| CN | 206957312 | U | 2/2018 |
| CN | 107965185 | A | 4/2018 |
| DE | 102007058931 | A1 | 6/2009 |
| EP | 0422915 | A2 | 4/1991 |
| EP | 1394339 | A2 | 3/2004 |
| FR | 2258500 | A1 | 8/1975 |
| FR | 2731026 | A1 | 8/1996 |
| FR | 3058430 | A1 | 5/2018 |
| GB | 2061208 | A | 5/1981 |
| GB | 2433285 | A | 6/2007 |
| GB | 2453048 | A | 3/2009 |
| GB | 2502362 | A | 11/2013 |
| IL | 91978 | A | 12/1991 |
| JP | H0635074 | A | 2/1994 |
| JP | H0674381 | A | 3/1994 |
| JP | H08-004196 | A | 1/1996 |
| JP | H10-054090 | A | 2/1998 |
| JP | H11-336182 | A | 12/1999 |
| JP | H11-336235 | A | 12/1999 |
| JP | 2000-140174 | A | 5/2000 |
| JP | 2000352196 | A | 12/2000 |
| JP | 2001164757 | A | 6/2001 |
| JP | 2002194809 | A | 7/2002 |
| JP | 2005002714 | A | 1/2005 |
| JP | 3119660 | U | 3/2006 |
| JP | 2009-155868 | A | 7/2009 |
| JP | 2011-196055 | A | 10/2011 |
| KR | 100610311 | B1 | 8/2006 |
| KR | 10-2010-0017011 | A | 2/2010 |
| KR | 10-2013-0063522 | A | 6/2013 |
| KR | 20-2016-0002972 | U | 8/2016 |
| KR | 2016-0002972 | U | 8/2016 |
| NO | 138291 | B | 5/1978 |
| WO | WO-01/53630 | A1 | 7/2001 |
| WO | WO-2017/219063 | A1 | 12/2017 |
| WO | WO-2017219069 | A1 | 12/2017 |
| WO | WO-2019006491 | A1 * | 1/2019 |
| WO | WO-2019/143298 | A1 | 7/2019 |
| WO | WO-2020/028947 | A1 | 2/2020 |
| WO | WO-2020/028948 | A1 | 2/2020 |

OTHER PUBLICATIONS

Chinese Patent Application No. 2019800648477, Office Action, issued Mar. 23, 2022.

Chinese Patent Application No. 2019800659325, Office Action, issued Apr. 27, 2022.

European Patent Application No. 19845957, Extended European Search Report, dated May 17, 2022.

European Patent Application No. 19847654.1, Extended European Search Report, dated Mar. 21, 2022.

International Application No. PCT/AU2019/050825, International Preliminary Report on Patentability, mailed Nov. 10, 2020.

International Application No. PCT/AU2019/050825, International Search Report and Written Opinion, mailed Oct. 25, 2019.

International Application No. PCT/AU2019/050825, Written Opinion of the International Preliminary Examining Authority, mailed Aug. 12, 2020.

International Application No. PCT/AU2019/050826, International Search Report and Written Opinion, mailed Oct. 21, 2019.

International Application No. PCT/AU2020/051429, International Search Report, mailing date of Feb. 16, 2021.

Japanese Patent Application No. 2024-094123, Notice of Reasons for Refusal, dated Jun. 17, 2025.

United Arab Emirates Patent Application No. P6000178/2021, Office Action and Search Report, dated Jun. 15, 2023.

* cited by examiner

METHOD OF CONSTRUCTION

CROSS-REFERENCE TO RELATED APPLICATIONS

This application is a U.S. National Phase of International Patent Application No. PCT/AU2020/051429 filed Dec. 23, 2020, which claims priority to Australian Patent Application No. 2020903837 filed on Oct. 22, 2020, and Australian Patent Application No. 2020903581 filed on Oct. 2, 2020, and Australian Patent Application No. 2019904948 filed on Dec. 24, 2019. The entire contents of each of these applications are incorporated herein by reference in their entirety.

TECHNICAL FIELD

This disclosure relates to multi-storey structures having an external facade and to methods of erecting or assembling the structure and facade.

BACKGROUND ART

Facades for multi-storey structures are known to utilise pre-fabricated modular elements that are affixed to a multi-storey structure after erection of the structure. In some forms, known methods of constructing multi-storey structures, a safety rail or scaffold is required to allow for pre-fabricated facade elements to be added to a floor at any level of a structure to provide the walls and, in some forms, windows of the structure. Known methods of erecting the multi-storey structure may comprise the steps of i) erecting a scaffold or perimeter screen ii) erecting support columns extending upwards from the ground or slab iii) building formwork for an upper floor iv) forming an upper floor v) repeating until the structure is the required height vi) removing the scaffold or perimeter screen and vii) attaching an external facade to the structure. Alternatively, known methods may include constructing a safety rail on any floor of a multi-storey structure and utilising a harness to prevent falls.

It is to be understood that, if any prior art is referred to herein, such reference does not constitute an admission that the prior art forms a part of the common general knowledge in the art in Australia or any other country.

SUMMARY

In its broadest terms, there is disclosed a method of erecting a multi-storey structure where the facade is installed before a floor is installed. In this way, the methodology reverses the traditional approach of constructing the floor structure of the building first and then attaching the facade subsequently to that floor structure. Moreover, the internal structure can be effectively built from the inside out with the facade forming a safety barrier envelope for that construction.

The construction process can follow an iterative approach where a portion of the facade is installed, a floor is erected, the facade is extended to then allow the next floor to be erected and so on.

The method may have the benefit of allowing construction of a multi-storey structure without requiring scaffolding or perimeter screen to be erected. This both can save on material cost in the construction and also significantly improves construction time. As the facade precedes the construction of the floors of the multi-storey building to an extent that allows for at least one subsequent floor to be erected within the envelope of the facade, a new construction process is provided that increases the speed of floor construction as it does not require the installation of separate safety barriers when that floor is being installed whilst allowing construction workers and equipment to work from within the building envelope to erect the subsequent floor. Moreover, the facade may provide integrated connectors to allow for rapid connection of the subsequent floor to the facade.

In one aspect, disclosed is a method of erecting a multi-storey structure having a facade disposed around at least a portion of a perimeter of the multi-storey structure, wherein during construction, at least a portion of the facade is disposed to extend at least two storeys height beyond an upper work area of the structure and forms at least part of a safety barrier for that work area and wherein in erecting the multi-story structure, at least one further floor of the structure is erected over the upper work area, with the or each further floor forming a respective subsequent upper work area of the structure, and wherein at least a portion of the facade is disposed to extend at least one storey height beyond the uppermost of the subsequent work areas and forms at least part of a safety barrier for that uppermost subsequent work area.

In some forms, the or each further floor is formed such that the floor connects with the façade.

In some forms, when the uppermost subsequent work area is formed, the facade is increased in height to extend at least two storeys height beyond the uppermost subsequent work area to enable at least one further floor of the structure to be erected whilst providing a safety barrier for that construction.

In a further aspect, there is disclosed a method of constructing a multi-storey building, the method comprising positioning a first facade assembly around at least a portion of a perimeter of a multi-storey building, the facade assembly comprising a facade structure of at least one storey height, the facade structure being positioned such that it extends upwardly beyond an upper work area of the building and forms part of a safety envelope for that work area; positioning a second facade assembly such that it extends upwardly from the first facade assembly, the second facade assembly comprising a second facade structure; connecting a floor to at least one of the first and second facade assemblies, such that the floor forms an uppermost floor erected over the upper work area.

In some forms, a further façade assembly is positioned to extend upwardly from the second façade assembly, such that an outer façade of at least two-storey height extends above the uppermost floor.

Further disclosed is a facade assembly configured to be disposed around at least a portion of a perimeter of a multi-storey building during construction, and disposed to extend beyond an upper work area of the building and form part of a safety envelope for that work area, the facade assembly being further arranged to be connected to at least one further floor erected over the upper work area, the facade assembly comprising a facade structure arranged to connect to at least one further facade assembly located above the facade structure.

In some forms the façade assembly comprises a support system that provides support for the facade structure prior to connection of the further floor to the facade assembly.

In some forms the support system is adjustable to allow for angular adjustment of the facade structure relative to the upper work area.

In some forms the facade is formed from a plurality of panels, and the panels form at least part of the safety barrier.

In some forms, the facade is formed as framework. In some forms the framework is formed from a plurality of frames that are connected together. In some forms, the frames form part of the facade panels. In other forms, these frames are formed as part of modules (that have a more three dimensional shape) that are interconnected together.

An advantage of using a frame structure for the facade is that they may have a higher strength to weight ratio than panels, they can be arranged to be simply connected together (using mechanical fasteners and the like), and they can support a variety of infill members material and structures. For example, the infill member may be a window or door, or replaceable barrier material. Also, the frame can be used to support or carry other components, such as services, loading platforms, balconies and the like.

In one form, the modules are self supporting. This has an advantage of enabling faster construction of the facade and can obviate the need for props and the like.

In some forms, the facade assembly may incorporate temporary support members that are used when first installed and on formation of the floors, but which are then removed after erecting of the floor and therefore do not form part of the final building structure. In some, these temporary supports may enable the facade assembly to be self supporting during installation Also disclosed is a method of constructing a multi-storey building, the method comprising: positioning a first facade assembly around at least a portion of a perimeter of a multi-storey building, the facade assembly being in the form of a module and comprising a facade structure of at least one storey height, the facade structure being positioned such that it extends upwardly beyond an upper work area of the building and forms part of a safety envelope for that work area;

In some forms, the module of the facade assembly is self supporting and arranged to be located in side by side and one on top of the other arrangement with other facade assembly modules.

In some forms, the facade panels or modules are arranged to be in the order of a floor height of the building. Depending on the height, this may be in the order of 3 to 4 meters but in certain circumstances may be more or less than that depending on the design specification of the building.

When the facade assembly is of a more modular structure, the depth of the modules may be provided in various depths. In some forms, these depths are 300 mm, 600 mm, 1.2 m, or 2.4 m. In some forms, these modules may form part of the resulting floor structure of the building.

In some forms, the floors of the building are arranged to be erected upper or lower margins of the panels or modules. In some forms the floors may straddle the join between adjacent panels. In some forms, facade assembly may include connectors to facilitate connection of the floors to the facade.

The method may have the benefit of allowing construction of a multi-storey structure without requiring an expensive scaffolding or perimeter screen to be erected. The method may also have the benefit of enhancing safety. This is because the facade may act as a perimeter screen or scaffolding, preventing falls from the structure. The method means the outer facade or outer walls of the structure and the scaffolding may be essentially integrated.

In some forms the facade panels are composed of a material sufficiently strong to act as a fall prevention and as a permanent facade including windows.

In some forms the facade panels prevent a person falling from the structure during and after building.

BRIEF DESCRIPTION OF THE DRAWINGS

Embodiments will now be described by way of example only, with reference to the accompanying drawings in which.

DETAILED DESCRIPTION

Figures 1A, 1B, 1C:
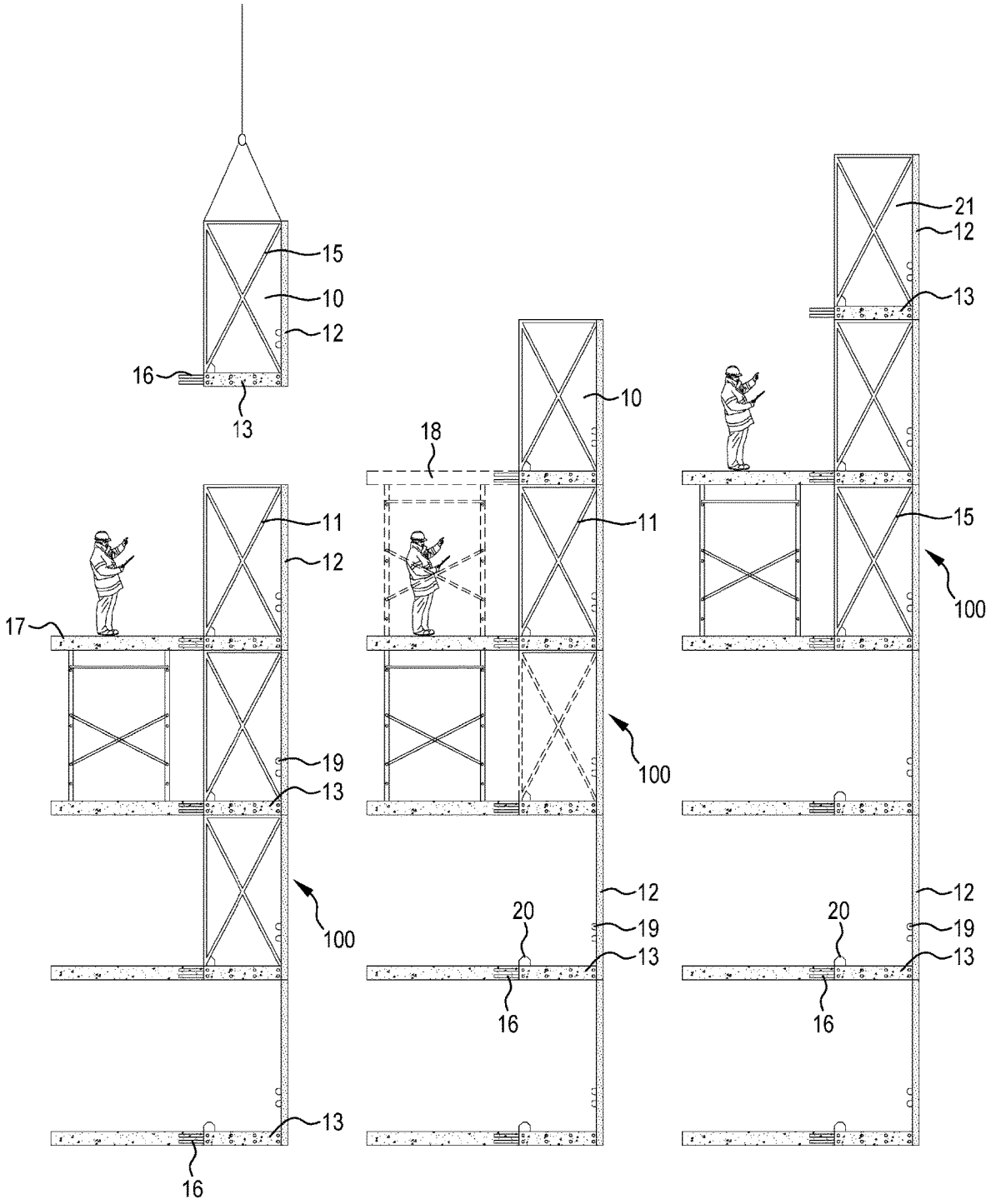
FIGS. 1A-C depict a method of one embodiment of the disclosure using an assembly of one embodiment of the disclosure.

In the following detailed description, reference is made to accompanying drawings which form a part of the detailed description. The illustrative embodiments described in the detailed description, depicted in the drawings and defined in the claims, are not intended to be limiting. Other embodiments may be utilised and other changes may be made without departing from the spirit or scope of the subject matter presented. It will be readily understood that the aspects of the present disclosure, as generally described herein and illustrated in the drawings can be arranged, substituted, combined, separated and designed in a wide variety of different configurations, all of which are contemplated in this disclosure.

Disclosed is a method of erecting a multi-storey structure having a facade disposed around at least a portion of a perimeter of the multi-storey structure, wherein during construction, at least a portion of the facade is disposed to extend beyond an upper work area of the structure and forms at least part of a safety barrier for that work area. In some forms the façade extends at least two storeys above an upper work area of the structure.

The method may comprise installing a façade assembly that extends at least two storeys above the most recently installed floor, then installing one or more floors, then installing further façade assemblies such that the façade assembly is always at least one storey above a workspace on the uppermost floor. The facade assembly comprises a permanent façade which acts as a scaffolding or fall prevention as well as providing the permanent architectural envelope which remains on the structure.

Disclosed is a method of erecting a multi-storey structure having a facade disposed around at least a portion of a perimeter of the multi-storey structure, wherein during construction, at least a portion of the facade is disposed to extend at least two storeys height beyond an upper work area of the structure and forms at least part of a safety barrier for that work area and wherein in erecting the multi-story structure, at least one further floor of the structure is erected over the upper work area, with the or each further floor forming a respective subsequent upper work area of the structure, and wherein at least a portion of the facade is disposed to extend at least one storey height beyond the uppermost of the subsequent work areas and forms at least part of a safety barrier for that uppermost subsequent work area.

Disclosed is a method of constructing a multi-storey building, the method comprising positioning a first facade assembly around at least a portion of a perimeter of a multi-storey building, the facade assembly comprising a facade structure of at least one storey height, the facade structure being positioned such that it extends upwardly beyond an upper work area of the building and forms part of a safety envelope for that work area; positioning a second facade assembly such that it extends upwardly from the first facade assembly, the second facade assembly comprising a second facade structure; connecting a floor to at least the first facade assembly, such that the floor forms an uppermost floor erected over the upper work area.

In some forms the method further comprising positioning a further façade assembly extending upwardly from the second façade assembly, such that an outer façade of at least two-storey height extends above the uppermost floor.

In some forms the facade assemblies further comprise support structures.

In some forms, the method comprises using the support structure of a respective facade assembly to adjust the angle of the facade structure with respect to the floor. In some forms the method comprises removing at least part of the support structure from the building.

Further, disclosed is a facade assembly configured to be disposed around at least a portion of a perimeter of a multi-storey building during construction, and disposed to extend beyond an upper work area of the building and form part of a safety envelope for that work area, the facade assembly being further arranged to be connected to at least one further floor erected over the upper work area, the facade assembly comprising a facade structure arranged to connect to at least one further facade assembly located above the facade structure.

In some forms the assembly comprises a support system that provides support for the facade structure prior to connection of the further floor to the facade assembly.

In some forms the support system is adjustable to allow for angular adjustment of the facade structure relative to the upper work area.

In some forms the support structure is removable from the facade structure.

In some forms the support structure comprises an upright section and a foot arranged to extend inwardly into the building in use.

In some forms the foot forms an extension of a floor of the building.

In some forms the support system comprises at least one brace that extends between the foot and the upright section.

In some forms the brace is extendable to change the angle of the upright with respect to the floor.

In some forms the facade structure and support system of the facade assembly are provided as a module.

In some forms the facade structure comprises a facade connector configured to connect the facade structure to the further facade assembly.

In some forms the façade assembly is formed from a plurality of panels, and the panels form at least part of the safety barrier.

In some forms the façade assembly includes one or more connection regions for connecting with one or more floors. In some forms upon forming the floor, the floor encases the connection region.

In some forms in erecting the structure at least a portion of the facade assembly is constructed prior to the uppermost floor such that the facade extends above the height at which a next floor will be built to form a safety barrier for the next floor.

The method allows workers to safely work on the upper work area without requiring independent fall barriers or scaffolding. The façade assembly is designed such that during construction at least a portion of a facade panel forming the facade extends above any work area to prevent falling from the work area.

In some forms, the upper floor connection members comprise a hook or bar or other formed connection extending from an inner face of the façade assembly.

In some forms, the upper floor connection members are welded to the façade assembly.

In some forms the upper floor connection members are bolted to the façade assembly.

In some forms the method further comprises attaching a bottom edge of a plurality of second storey facade assemblies to a top edge of the plurality of facade panel assemblies.

In some forms, the facade panels are located adjacent one another.

In some forms the facade panels are composed of structural steel. In some forms the facade panels include ventilation openings. In some forms the facade panels are in the form of slatted, latticed or perforated steel. In some forms the facade panels are decorative.

In some forms the facade panel comprises a structural frame and an external face engaged with the structural frame. In some forms the external face is waterproof. In some forms the facade panel further comprises an internal face engaged with the structural frame. In some forms insulation is located between the external and internal faces. In some forms the facade panel includes a window or glass.

In some forms, the facade assembly is formed as a modular frame structure having an inner frame and an outer frame. In some form, the facade structure is formed on the outer frame. In some forms, the facade structure is formed on the inner frame and the outer frame is arranged to be an external feature of the building.

In some forms the facade panel may be a solid composite panel.

In some forms the facade panel or module is composed aluminium, glass, a combination of aluminium and glass, aluminium, a composite material, concrete, steel, steel and glass or any other construction material. In some forms the facade panel or panel may be load bearing. In some forms when the panel is load bearing it is composed of concrete, structural steel or other load bearing material.

In some forms the panels are configured to act as a fall prevention system and the permanent facade of the structure.

Referring now to FIG. 1, disclosed is a method of constructing a multi-storey building such as a multi-storey car park, an apartment building or a high-rise structure, the structure having a facade. In the illustrated form the multi-storey building may be a parking structure.

As shown in FIG. 1A, a façade assembly 10 is in the process of being installed above a previously installed façade assembly 11 such that 10 and 11 combine to form a two storey façade assembly erected to extend upwardly from an upper floor 17. When facade assembly 10 is installed, the outer façade 100 of the overall structure extends two storeys above the uppermost floor.

The façade assembly 10 is installed as a module and includes a façade structure 12 (in the form of a steel panel)

and a lower horizontal section 13. The façade assembly also includes a support structure 15 which comprises support and bracing to support and line-up the façade assemblies.

The façade assembly 10 further includes connectors 16. In the illustrated form the connectors are in the form of reinforcement bar which extends outwardly from the lower horizontal section 13.

An upper work area 17 is located on the uppermost floor. The façade assemblies extend two storeys above the work area 17.

As shown in FIG. 1B, once the module 10 is installed, an further floor 18 is built above the upper work area 17 and connected with the façade assembly at the connectors 16. In building the floor further temporary supports 22 may be included. In the illustrated form the connectors extend at the connection between façade assembly 10 and previously installed façade assembly 11. The connectors 16 in the form of reinforcement bars is encased and cast in concrete when the upper floor 18 is built. Also as shown in FIG. 1B the support 15 is in some forms temporary and may be removed.

Figure 10:
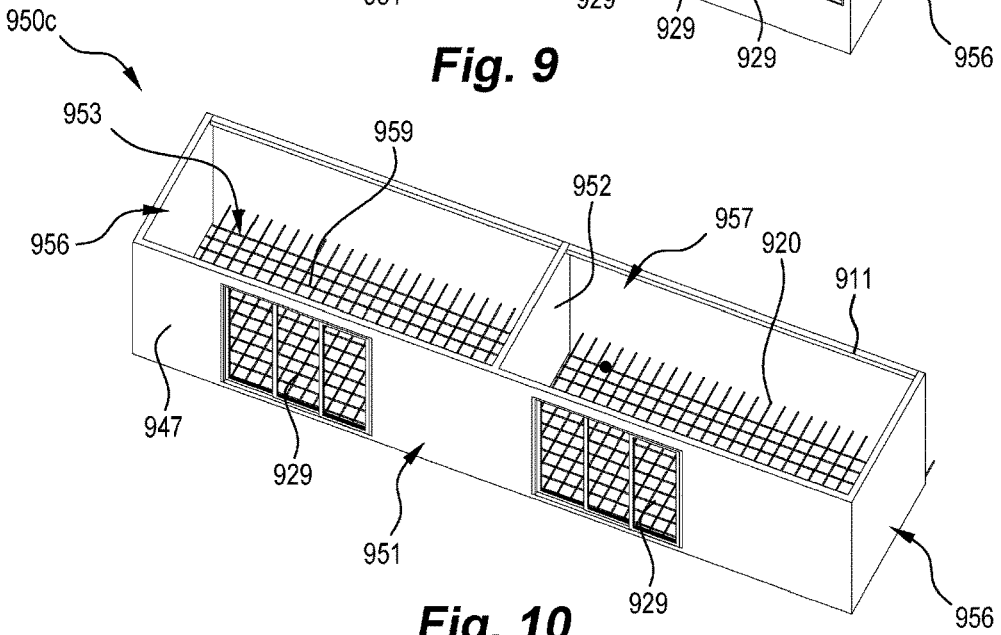

As shown in FIG. 10, once the new uppermost floor is built, a further façade assembly 21 is located above the façade assembly 10 so that the outer façade 20 maintains a two-storey height above the uppermost floor.

Once the subsequent floors are erected, the temporary supports which form part of the facade assemblies on lower floors may be removed to thereby leave the final facade panel 12 and horizontal section 13 which forms part of the respective floor.

In the embodiment shown in FIG. 1, safety crash barrier 19 and a wheel stop 20 may be incorporated into the façade assembly.

The facade assemblies as illustrated are arranged to be in the order of a floor height of the building. Depending on the height, this may be in the order of 3 to 4 meters but in certain circumstances may be more or less than that depending on the design specification of the building.

When the facade assembly is of a more modular structure as shown, the depth of the modules may be provided in various depths. In some forms, these depths are 300 mm, 600 mm, 1.2 m, or 2.4 m.

In some forms, these modules may form part of the resulting floor structure of the building. In the case of FIGS. 1*a* to 1C, the facade assemblies are arranged to have a depth of approximately 1.2 m.

The fame assemblies 10, 11 may be provided to site as an integrated unit and lifted into place as a single unit. Whilst the temporary support components of the frame assemblies are required whilst the frame assembly extends above the upper work area, once a floor is installed those temporary supports may be removed to leave the facade, floor and other fixtures that remain with the structure.

The multi-storey structure 10 comprises a plurality of facade panels 12 forming an outer facade 13 of the multi-storey structure. The floors 14 of the multi-storey structure are contained within the facade 13. The facade panels 12 include a panel engagement section 15 which is configured to allow a facade panel 12 to be engaged with a facade panel above or below within the outer facade 13. The facade panels 12 further include a floor connection section 17 which is adapted to connect or engage a floor 14 with the facade panel 12.

FIG. 1 shows one version of a construction method of a multi-storey carpark or other structure which includes crash barriers. Alternative embodiments are available.

Referring now to FIG. 2, an embodiment of a method of constructing a multi-storey structure having an outer façade is shown. The multi-storey structure may comprise a school, apartment, office, shopping centre, hospital, car park, high rise, or any type of structure. The method comprises installing a façade assembly such that the façade panels of the façade assembly extend upwardly two floors above an uppermost floor before work occurs on the uppermost floor.

Figure 2A:
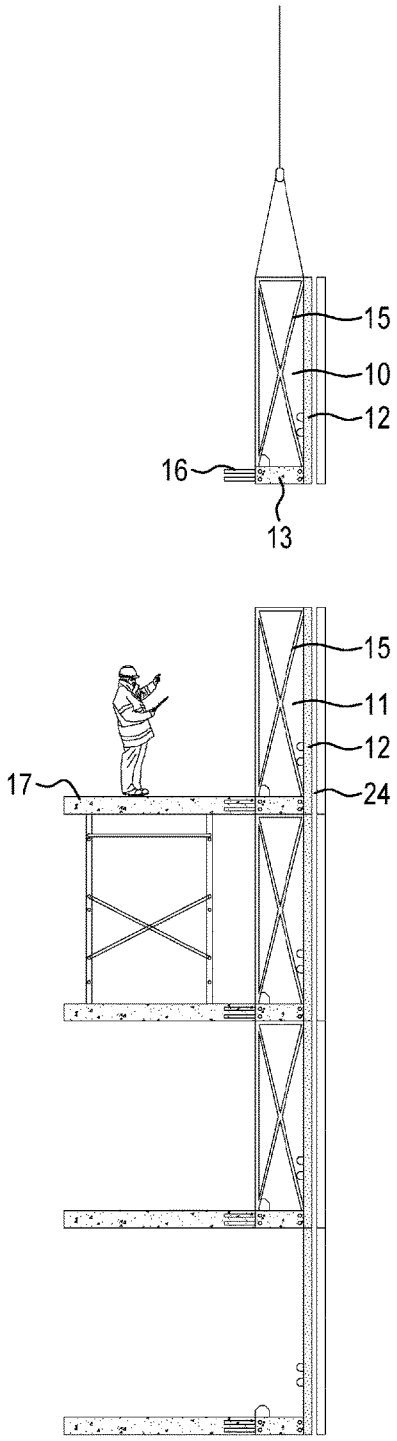
FIGS. 2A-C depict a method of one embodiment of the disclosure using an assembly of one embodiment of the disclosure.

As shown in FIG. 2A, a façade assembly 10 is being installed above a previously installed façade assembly 11 such that assemblies 10 and 11 combine to form a two storey façade assembly erected to extend upwardly from an upper floor 17. The façade assembly 10 includes a façade panel 12 and a lower horizontal section 13. The façade assembly also includes a support structure 15 which comprises support and bracing to support and line-up the façade assemblies. The facade structure 12 may be formed having a supporting frame 24 and outer infill structure which forms the exterior of the structure an may be glass or the like.

The facade assemblies as illustrated in FIG. 2 are arranged to be in the order of a floor height of the building. Depending on the height, this may be in the order of 3 to 4 meters but in certain circumstances may be more or less than that depending on the design specification of the building.

When the facade assembly is of a more modular structure as shown, the depth of the modules may be provided in various depths. In some forms, these depths are 300 mm, 600 mm, 1.2 m, or 2.4 m.

Figure 2B:
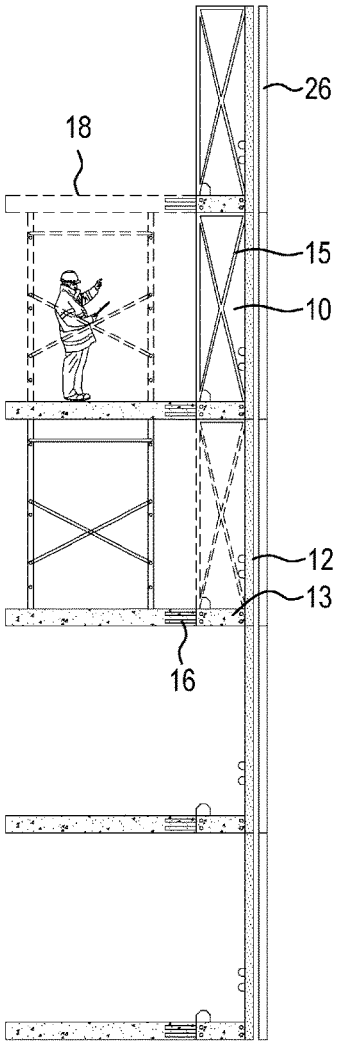
Figure 2C:
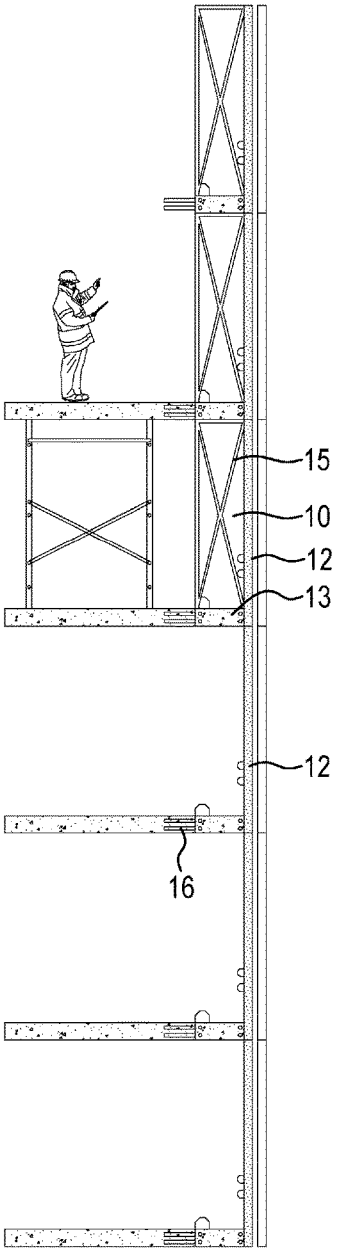

In some forms, these modules may form part of the resulting floor structure of the building. In the case of FIGS. 2A to 2C, the facade assemblies are arranged to have a depth of approximately 600 m The façade assembly 10 further includes connectors 16. In the illustrated form the connectors are in the form of reinforcement bar which extends outwardly from the lower horizontal section 13.

An upper work area 17 is located on the uppermost floor. The façade assemblies extend two storeys above the work area 17 and forms a safety barrier envelop for the workers in the construction site.

As shown in FIG. 2B, an upper floor 18 is built above the upper work area 17 and connected with the façade assembly at the connectors. In the illustrated form the connectors extend at the connection between façade assembly 10 and previously installed façade assembly 11. The connectors 16 in the form of reinforcement bars is encased and cast in concrete when the upper floor 18 is built. Also as shown in FIG. 2B the support 15 is in some forms temporary and may be removed.

As shown in FIG. 2C, once the new uppermost floor is built, a further façade assembly 21 is located above the façade assembly 10 so that the outer façade 20 maintains a two-storey height above the uppermost floor.

Referring now to FIG. 3, a further embodiment of a method of constructing a multi-storey structure having an outer façade is shown. The multi-storey structure may comprise a school, apartment, office, shopping centre, hospital, car park, high rise, or any type of structure. The method comprises installing a façade assembly such that the façade panels of the façade assembly extend upwardly two floors above an uppermost floor before work occurs on the uppermost floor.

Figures 3A, 3B, 3C:
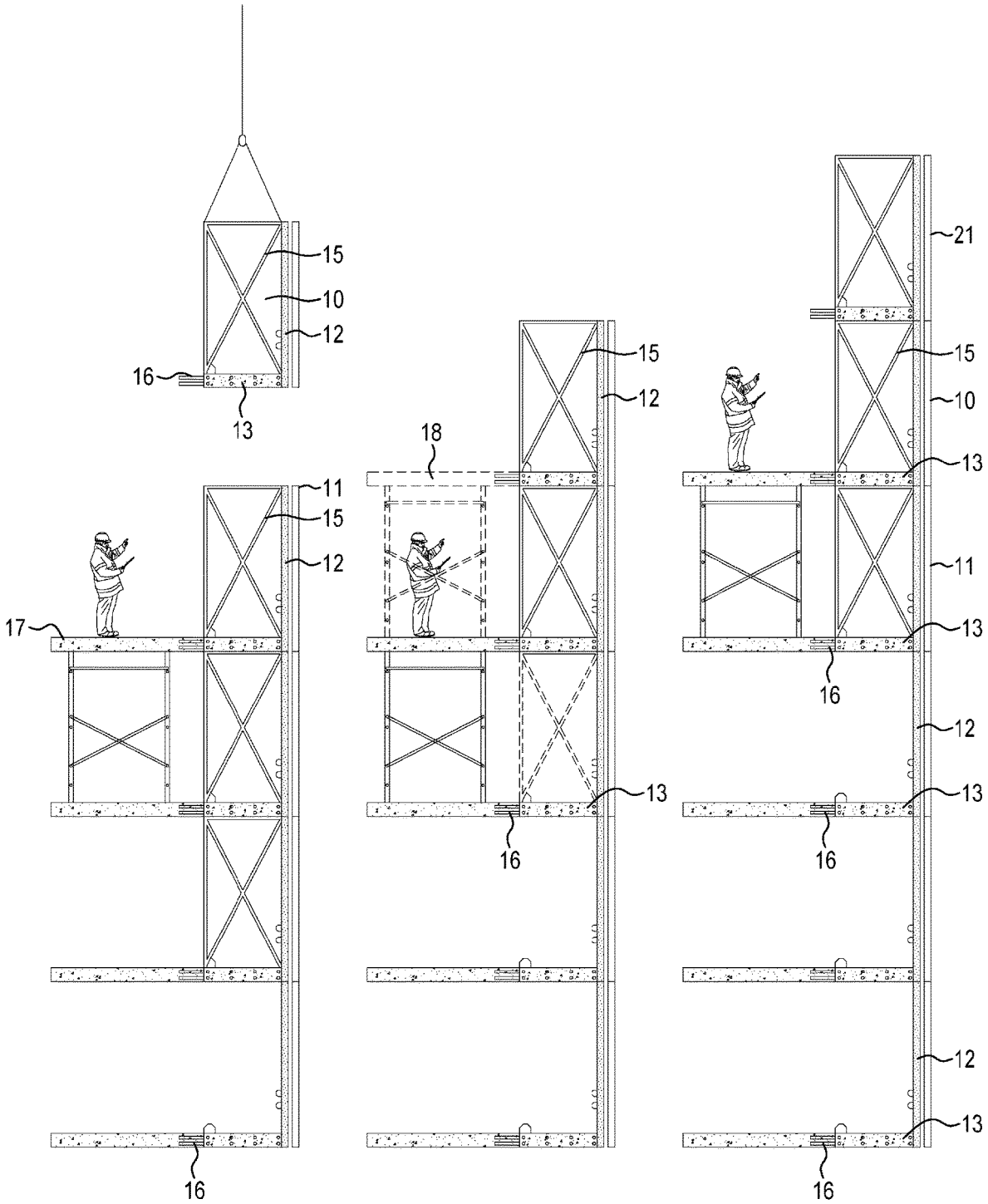
FIGS. 3A-C depict a method of one embodiment of the disclosure using an assembly of one embodiment of the disclosure.

As shown in FIG. 3A, a façade assembly 10 is in modular form and is installed above a previously installed façade assembly 11 such that 10 and 11 combine to form a two storey façade assembly erected to extend upwardly from an upper floor 17. The façade assembly 10 includes a façade panel 12 and a lower horizontal section 13. The façade assembly also includes a support structure 15 which comprises support and bracing to support and line-up the façade assemblies.

The façade assembly 10 further includes connectors 16. In the illustrated form the connectors are in the form of reinforcement bar which extends outwardly from the lower horizontal section 13.

An upper work area 17 is located on the uppermost floor. The façade assemblies extend two storeys above the work area 17.

As shown in FIG. 3B, an upper floor 18 is built above the upper work area 17 and connected with the façade assembly at the connectors. In the illustrated form the connectors extend at the connection between façade assembly 10 and previously installed façade assembly 11. The connectors 16 in the form of reinforcement bars is encased and cast in concrete when the upper floor 18 is built. Also as shown in FIG. 2B the support 15 is in some forms temporary and may be removed.

As shown in FIG. 3C, once the new uppermost floor is built, a further façade assembly 21 is located above the façade assembly 10 so that the outer façade 20 maintains a two-storey height above the uppermost floor.

The illustrated arrangement of FIG. 3A to 3C is similar to FIG. 2A to 2C. A primary difference is the width of the facade assemblies which are wider and in the order of 1.2 m.

In accordance with the design, if required, one or more further facade assembly may be erected over the existing installed facade assemblies such that the facade extends more than two stories above any floor. As the facade is arranged to provide a safety barrier to workers assembling the internal structures and floors of the building, it is considered that one storey height is sufficient to ensure adequate safety. However, additional storey heights are catered for within the methodology disclosed if need be. As the extended facade height needs to cater from wind loading and the like, if it was desirable to further extend the facade additional supporting structures may be required and on increased strength in the facade structures.

The multi-storey structure of the disclosure may be constructed by locating a lowermost level comprising a plurality of facade assembly about a lower or ground floor of the structure. The lowermost facade panels may be located at ground level or above ground level on a first floor of the structure or intermediate the ground and a first floor. An upper level of façade assemblies is located above the lower level of façade assemblies. A floor connection section 17 is located on the interior face of the facade assemblies. Once the upper floor facade assemblies are positioned, formwork and supporting struts or similar for a floor are put in. The floor is then built, constructed or cast around the floor connection section such that the floor and the façade assemblies are engaged. A worker can then position the next facade assemblies such that the outer façade of the structure still extends two storeys above the uppermost floor. The process continues until the structure is the required number of storeys.

As can be seen, throughout the process, the facade is positioned and extends at least two storeys upwardly before the upper floors are built. This allows the facade to act as a fall prevention screen and allows for an upper work area to be safely positioned on the uppermost floor. Once the project is completed the facade remains as an outer wall or facade of the structure.

The floor may be supported by the construction. In some forms the floor may be supported by the facade panels. In this form the panels are load bearing and are composed of material that can be load bearing. In alternative forms the floors may be supported by independent steel or concrete columns.

The floor may be composed of any flooring material. In some forms the floor is formed of precast concrete. In other forms the floor comprises a steel form with concrete cast thereon. In some forms the floor comprises reinforced concrete. In some forms the floor comprises structural steel and decking. In some forms the floor comprises structural timber, in some forms the floor is composed of a composite material.

In some forms, the panels of the disclosure may comprise panel frames that act as part of the building's permanent facade with infill material mesh that may be replaced. For example, frames may include a removable infill panel which can be replaced with glass or other material. In other forms, the panels may comprise frames and wall material that will act as the permanent facade of the building along with an interior protective material that can be removed once construction is performed. For example, the panels could comprise a glass exterior and a board or polymer interior removable material.

FIGS. 4 to 10, disclose a method of construction a multistorey structure where, the facade may be provided in the form of, or incorporated as part of, modules 950. The modules can be arranged to extend around the perimeter of a structure to form the facade of a multi-storey structure 900, and in some embodiments to also form part of the floor space of that structure.

In one form as illustrated, the modules 950 comprise a floor portion 953 and a plurality of walls extending therefrom. In the form shown in FIGS. 4 to 10, the modules 950 having cuboid profiles. In other forms, the modules can be shaped with polygonal profiles having more than four sides, for example, an octagonal profile. In another further example, arranging octagonally profiled modules in a side-by-side relation can provide an external profile to the multi-storey structure 900, e.g. a curvature-like profile. In this way, it is anticipated that the shape provided to the module can be dictated by the architectural design of the particular multi-storey structure. In some forms, the barrier structure of the facade (e.g. window, door and/or wall) may be provided on an outer wall of the module or may be on an inner wall such that the structure 500 may have an external frame, balcony or the like.

A feature of the modules is that they provide additional properties to the facade over a facade made solely from a barrier structure. As such, the modules may have improved load bearing performance, may be more stable, and/or may provide additional functional requirements (for example for noise control, heating/cooling and or services). The plurality of walls in the self-supporting modules also provide lateral stability to the module. This lateral stability allows the modules to be self-supporting, or at least require less temporary supports over planar type facade members. In some forms, the modules are substantially self-supporting, wherein additional support can be provided by, e.g. ties, props, etc, to an adjoining multi-storey structure 900. In this form, the ties can be temporarily provided to assist supporting the module during construction of the multi-storey structure. It is an advantage that the module in this form requires fewer ties compared to individually arranged façade panels, i.e. panels that are not pre-fabricated as modules.

In some other forms, the modules 950 are structured to stand alone without requiring mounting by, e.g. ties, to an adjoining multi-storey structure 900. Advantageously, this eliminates the need for temporary props to construct the modules, therefore simplifying the construction process. Consistent with the earlier embodiments, the facade modules may be installed such that they extend at least two storeys above an existing work area (floor of the building) and whereafter a subsequent floor is installed and an additional storey of the facade module is installed to maintain the at least two storey facade extension. This allows for more efficient construction technique.

The modules 950 can accommodate structural loading over a broader surface than individual façade panels. Advantageously, this provides improved stability to the module during the construction of a multi-storey structure.

Figure 4:
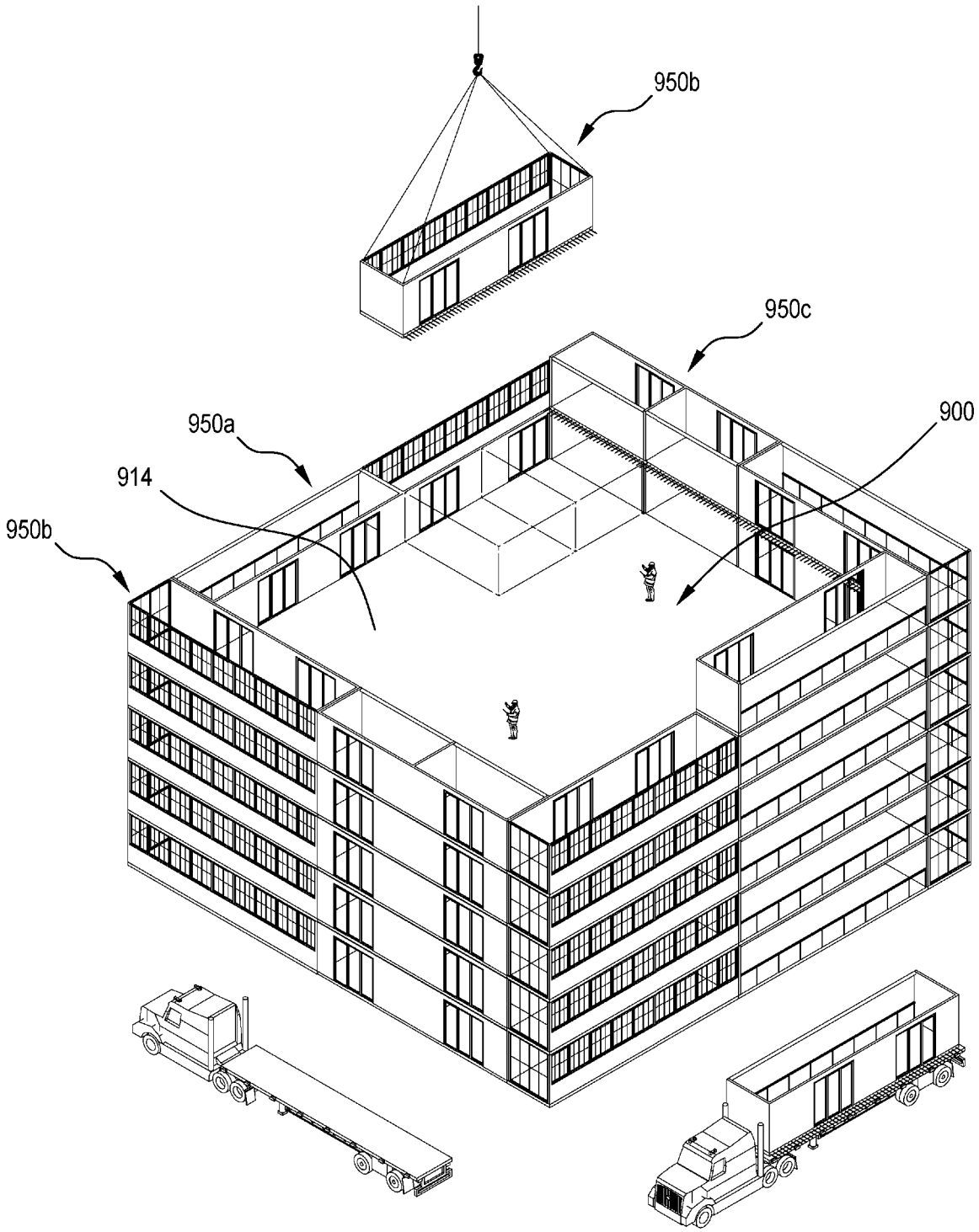
FIG. 4 depicts embodiments of modules arranged around the perimeter of a structure to form the facade of a multi-storey structure.

In some forms, the walls and floor 953 of the modules define an interior space that can support various functionalities. Referring to FIG. 4, the self-supporting modules are configured as balcony modules 950*a*, enclosed balcony modules 950*b*, and modules having no balcony 950*c*.

As illustrated in FIG. 4, any arrangement of self-supporting modules can be provided in the multi-storey structure. For example, modules functioning as balconies can be arranged adjacent to modules functioning as enclosed balconies. The arrangement of modules can be chosen according to the specific architectural design of a structure.

In some forms, modules 950 can be used for providing shielding to a multi-storey structure. For example, the interior space defined by the module can utilised to shield the multi-storey structure from heat, by providing a means of insulation. It is further envisaged that the module can shield from light penetration into the multi-storey structure. Alternatively, the modules could be configured to encourage light penetration into a multistorey structure for, e.g. natural lighting.

In some further forms, the modules can function to support services, for example, ventilation, air-conditioning, electrical cabling, water pipes, sewerage or drainage pipes, etc. Adjoining modules can be configured so as to provide access between modules. For example, doorways can be provided between adjoining modules. In another example, adjoining modules are not separated by walls, so as to provide uninterrupted passageway between the modules.

The self-supporting modules can be assembled about the structure 900 side-by-side or above-and-below one another. As shown in FIG. 4, the modules 950 are arranged in position on the multi-storey structure 900 by, e.g. crane. Further, the modules 950 can be transported to a worksite of the multi-storey structure by truck. It is an advantage that modules can be transported by both truck and crane in a pre-assembled and self-supporting arrangement. This can aid the efficiency of construction in multi-storey structures. Further the modules may be installed in single (storey) height units or in multiple height units as required.

Referring now to FIGS. 5 to 10, in some forms, the modules 950 comprise a floor portion 953 and a plurality of walls extending therefrom. In the form shown in FIGS. 5 to 7, the floor portion is a pre-formed composite floor that incorporates reinforcing bar (rebar). In the form shown in FIGS. 8 to 10, the floor portion 953 comprises reinforcing bar (rebar) 959 configured to be incorporated into a poured floor. In some forms the floor portion can comprise permanent formwork, and in other forms, removable formwork can be utilised. When the floor portion 953 is poured, the rebar 959 is incorporated between the floor portion 953 of the module 950 and the floor 914 of the structure 900.

In both forms shown in FIGS. 5 to 10, the rebar can be configured to extend from the floor portion 953 as connectors 920 for connecting the floor portion 953 to the structure 900. The connectors can be configured and positioned such that after locating the modules 950 on the structure 900, the floor 914 can be poured to incorporate the connectors as reinforcement for the floor.

Referring to FIGS. 5 to 10, the walls extending from the floor portion 953 of the modules 950 can take the form of inner walls 957, outer walls 951 and side walls 956. The inner wall and the outer wall are spaced apart from one another in a direction away from the structure 900. Side walls 956 connect the inner wall 957 and the outer wall 951.

Figure 6:
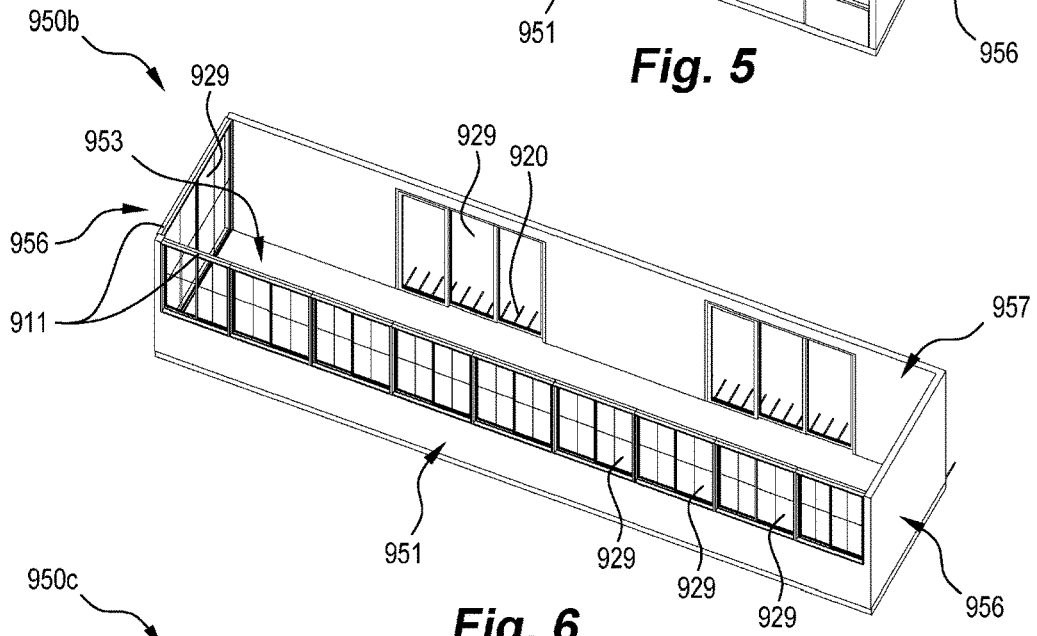
Figure 7:
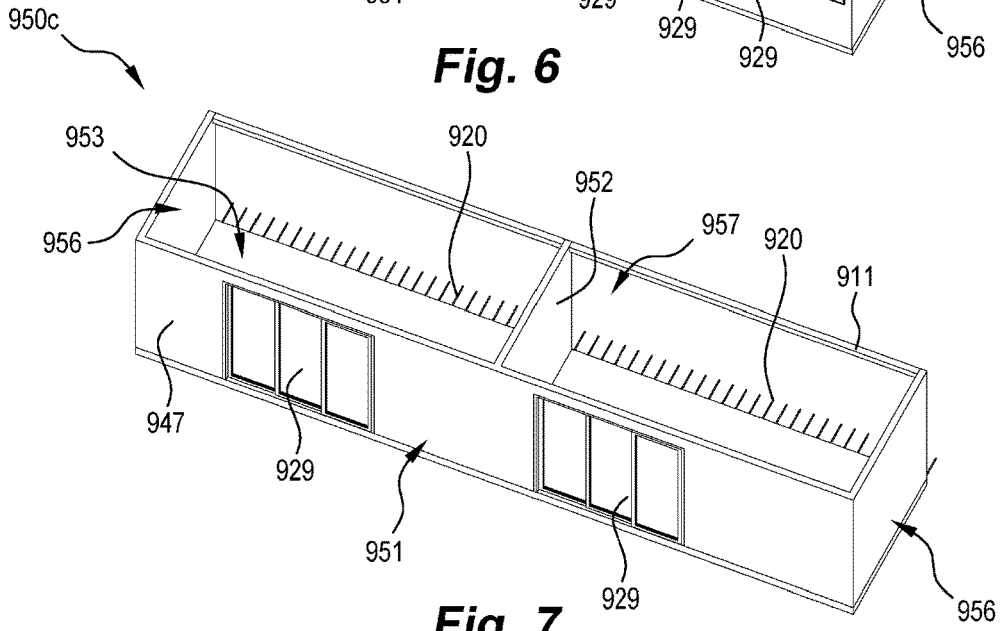

In some forms, and as best shown in FIGS. 7 and 10, the self-supporting modules 950 can comprise a further wall portion 952 to additionally connect between the inner wall and the outer wall. In some other forms, and as best shown in FIGS. 5, 6 and FIGS. 8, 9, the outer wall 951, inner wall 957 and side wall 956 can also comprise upper frame members 911.

In some forms, the walls are paneled and can have external faces 947 and internal faces 949 in between which is a cavity that may contain insulation. The external faces are typically externally facing panels that may be waterproof and can be composed of non-combustible cladding, cement sheet or board, aluminium or any other structural material for the external facade of a building. The internal faces are typically internally facing panels, i.e. panels facing towards the interior space of a module and may comprise plaster board or an alternative interior facade material.

The walls of the module 950 can comprise openings 929 that can take the form of windows, doors or louvre panels extending through the external and internal faces of the outer, inner or side walls.

Figure 5:
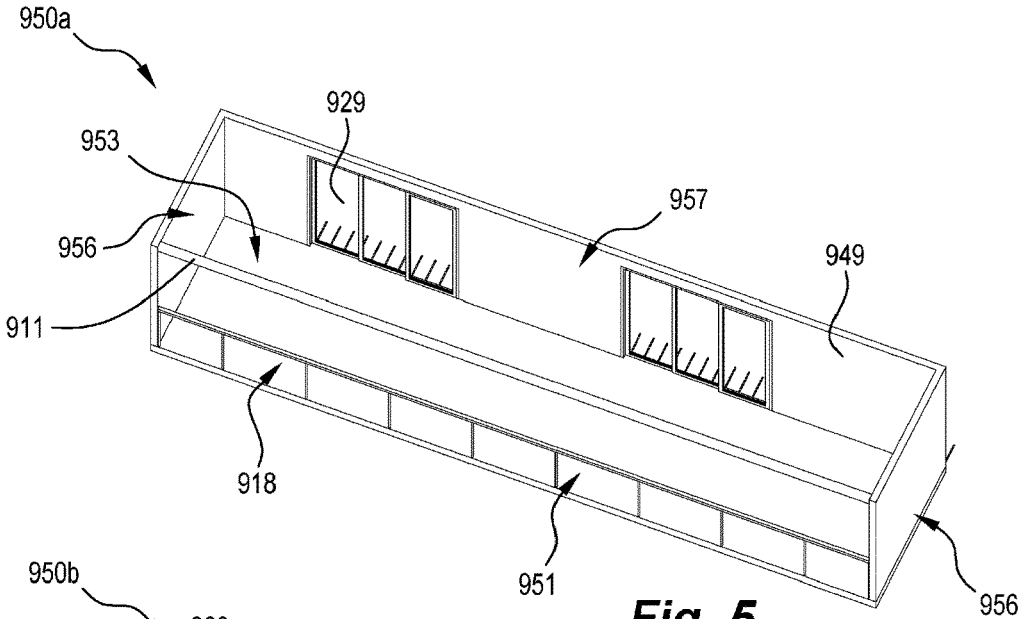
FIGS. 5-7 depict embodiments of self-supporting modules having a prefabricated floor portion.
Figure 8:
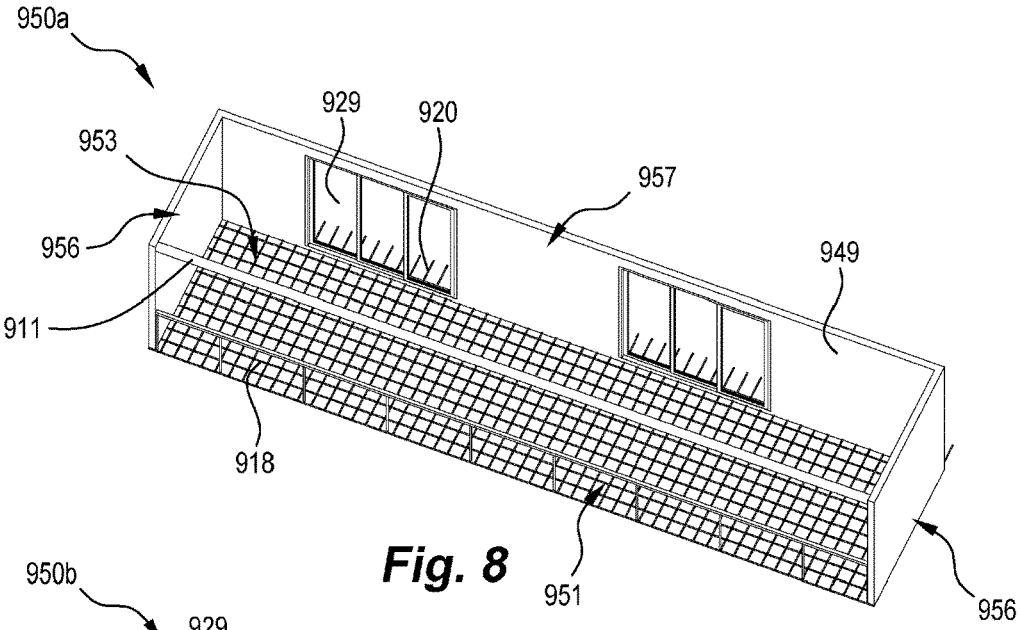
FIGS. 8-10 depict embodiments of self-supporting modules having reinforcing bar to be incorporated into a poured floor.

Referring to FIG. 5 and FIG. 8, in some forms the self-supporting module 950 is a balcony module 950*a*, wherein the module includes a balcony or other deck. The balcony module comprises an inner wall 957 and an outer wall 951 spaced apart by side walls 956. The outer wall can comprise an upper wall member 911 and lower barrier 918 positioned about a lower portion of the outer wall and adjacent to the floor portion 953. In some forms the lower barrier can be a balustrade extending between the side walls 956. The inner wall of the balcony module 950*a* can comprise openings 929 in the form of doors or windows.

Figure 9:
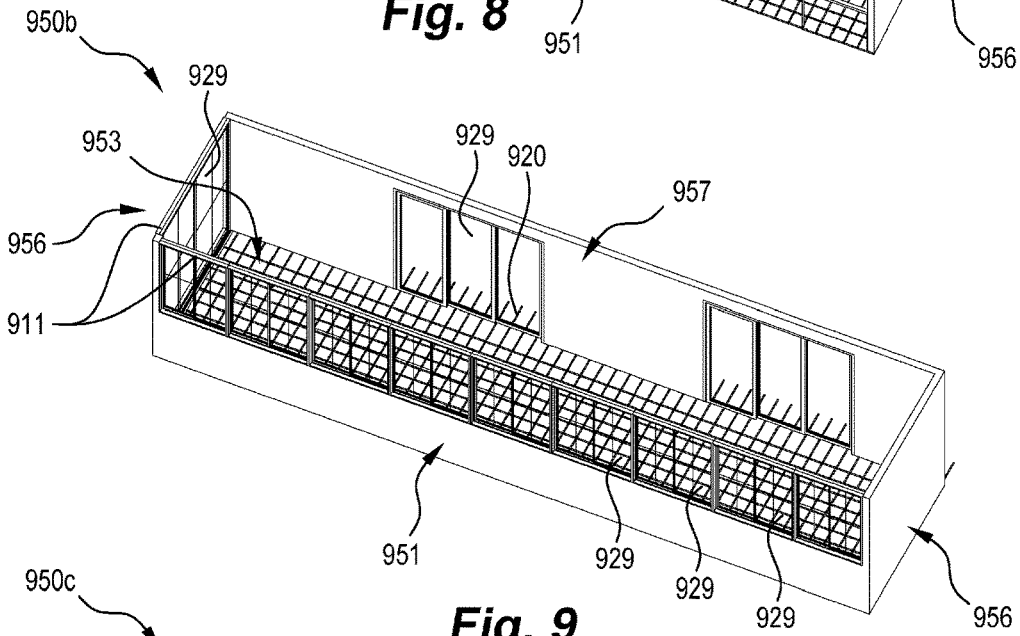

Referring to FIG. 6 and FIG. 9, in some forms the self-supporting module 950 is an enclosed balcony module 950*b*. The enclosed balcony module 950*b* primarily differs from the balcony module 950*a* by the addition of fixed windows 929 extending between the lower barrier 918 and an upper wall member 911 for enclosing the balcony module. In the form shown in FIGS. 6 and 9, the side walls 956 of the enclosed balcony can also comprise fixed windows 929 extending between the floor portion 953 and an upper wall member 911.

Referring now to FIG. 7 and FIG. 10, in some forms the self-supporting module 950 in substantially enclosed, such that it does not comprise a balcony. The self-supporting module 950*c* primarily differs from the balcony modules 950*a* and 950*b* in that it is enclosed by the outer wall and side walls and does not comprise an internal wall. The module 950*c* opens at one side for adjoining with the multi-storey structure so as to provide access into the module.

In the form shown in FIGS. 7 and 10, a further wall portion 952 extends from the outer wall towards an upper wall member 911 extending between the side walls 956. The further wall portion acts to subdivide the module and can provide further lateral stability to the module.

The facade modules disclosed above may be made from solid panelised structures or may be formed as a skeletal frame (typically having steel or metal load bearing members, with infill members as required.

Variations and modifications may be made to the parts previously described without departing from the spirit or ambit of the disclosure.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A method of erecting a multi-storey structure having a facade disposed around at least a portion of a perimeter of the multi-storey structure, wherein during construction, installing at least a portion of the facade to extend at least two storeys height beyond an upper work area of the structure, the facade forming at least part of a safety barrier for the upper work area and for the construction of at least one further floor of the structure over the upper work area, the facade comprising a plurality of self-supporting modules that are secured in side by side and one on top of the other arrangement to extend the at least two storeys height beyond the upper work area; and erecting the at least one further floor of the structure is erected over the upper work area, with the or each further floor forming a respective subsequent upper work area of the structure, and wherein at least a portion of the facade comprising the self-supporting modules extending at least one storey height beyond the subsequent work area and forms at least part of a safety barrier for the subsequent work area.

2. A method of erecting a multi-storey structure according to claim 1, wherein the or each further floor is formed such that the floor connects with the facade.

3. A method of erecting a multi-storey structure according to claim 1, wherein once the uppermost work area is formed, the facade is increased in height to extend at least two storeys height beyond the subsequent work area to enable at least one further floor of the structure to be erected whilst providing a safety barrier for that construction.

4. A method of erecting a multi-storey structure according to claim 1, wherein the facade is formed as a framework, and each of the self-supporting modules comprising a frame that in use form part of the facade framework.

5. A method of erecting a multi-storey structure according to claim 3, further comprising installing further ones of the self-supporting facade modules on the facade to increase the height of the facade.

6. A method of erecting a multi-storey structure according to claim 1, wherein the modules are generally cuboid.

7. A method of erecting a multi-storey structure according to claim 1, wherein the modules have a base that forms part of the floor plate of the structure.

8. A method of erecting a multi-storey structure according to claim 1, wherein the self-supporting facade modules are one storey in height.

9. A method of erecting a multi-storey structure according to claim 1, further comprising supporting services for the multi-storey structure comprising ventilation, air-conditioning, electrical cabling, water pipes, sewerage or drainage pipes, the supporting services being positioned within the facade formed from the self-supporting facade modules.

* * * * *